US005909228A

United States Patent [19]

Takahashi

[11] Patent Number: 5,909,228

[45] Date of Patent: Jun. 1, 1999

[54] INK-JET DEVICE HAVING PHASE SHIFTED DRIVING SIGNALS AND A DRIVING METHOD THEREOF

[75] Inventor: Yoshikazu Takahashi, Nagoya, Japan

[73] Assignee: Brother Kogyo Kabushiki Kaisha, Nagoya, Japan

[21] Appl. No.: 08/665,534

[22] Filed: Jun. 18, 1996

[30] Foreign Application Priority Data

Aug. 9, 1995 [JP] Japan ..... 7-203176
Mar. 4, 1996 [JP] Japan ..... 8-046402

[51] Int. Cl.[6] ..... B41J 29/38

[52] U.S. Cl. ..... 347/10; 347/11

[58] Field of Search ..... 347/9, 10, 11, 347/12, 13, 40

[56] References Cited

U.S. PATENT DOCUMENTS

| | | | |
|---|---|---|---|
| 3,946,398 | 3/1976 | Kyser et al. | 347/70 |
| 4,087,825 | 5/1978 | Chen et al. | 347/15 |
| 4,266,232 | 5/1981 | Juliana, Jr. et al. | 347/68 |
| 4,845,514 | 7/1989 | Mitsushima et al. | 347/194 |
| 4,879,568 | 11/1989 | Bartky et al. | 347/69 |
| 4,992,808 | 2/1991 | Bartky et al. | 347/69 |
| 5,036,337 | 7/1991 | Rezanka | 347/14 |
| 5,300,968 | 4/1994 | Hawkins | 347/12 |
| 5,550,568 | 8/1996 | Misumi | 347/40 |

FOREIGN PATENT DOCUMENTS 55-27282 2/1980 Japan .

*Primary Examiner*—Benjamin R. Fuller
*Assistant Examiner*—C. Dickens
*Attorney, Agent, or Firm*—Oliff & Berridge

[57] ABSTRACT

An ink-jet device and a method for driving the ink-jet device, wherein the pulse width WB of a second driving waveform agrees with a one-way propagation time T, 12 μsec, of an ink pressure wave in ink flow passages. Therefore, there is established a relatively high pressure in the vicinity of nozzles of the ink flow passages, ejecting the ink from the nozzles at a relatively high jet velocity. The pulse width WA of a first driving waveform is shorter than the one-way propagation time T, of the ink pressure wave in the ink flow passages so that ink pressure is reduced in the vicinity of the nozzles of the ink flow passages, causing ink ejection from the nozzles at a slower jet velocity as compared with ink projection with the second driving waveform. On a recording medium, therefore, high-quality printing can be effected without deviation of an ink-jet target position, regardless of the phase of the driving waveform.

19 Claims, 7 Drawing Sheets

Fig.8

| WA (L/a) | VELOCITY (m/s) | AMOUNT OF INK DROPLETS (pl) |
|---|---|---|
| 0.3 | × | × |
| 0.4 | 2.5 | 20 |
| 0.5 | 3.5 | 25 |
| 0.6 | 4.5 | 30 |
| 0.7 | 5.0 | 35 |
| 0.8 | 5.2 | 37 |
| 0.9 | 5.4 | 39 |
| 1.0 | 5.6 | 40 |
| 1.1 | 5.4 | 39 |
| 1.2 | 5.2 | 37 |
| 1.3 | 5.0 | 35 |
| 1.4 | 4.5 | 30 |
| 1.6 | 3.4 | 24 |
| 1.8 | 2.4 | 20 |
| 1.9 | × | × |
| 2.0 | × | × |
| 2.1 | × | × |
| 2.3 | 2.5 | 20 |

| WA (L/a) | VELOCITY (m/s) | AMOUNT OF INK DROPLETS (pl) |
|---|---|---|
| 2.5 | 3.1 | 23 |
| 2.6 | 3.6 | 26 |
| 2.7 | 4.0 | 27 |
| 2.9 | 4.3 | 28 |
| 3.0 | 4.5 | 30 |
| 3.1 | 4.3 | 28 |
| 3.3 | 4.0 | 27 |
| 3.4 | 3.5 | 25 |
| 3.5 | 3.0 | 23 |
| 3.6 | 2.5 | 21 |
| 3.8 | × | × |
| 4.0 | × | × |
| 4.3 | 2.0 | 20 |
| 4.5 | 2.5 | 21 |
| 4.8 | 3.0 | 23 |
| 5.0 | 3.5 | 25 |
| 5.5 | 2.0 | 20 |
| 6.0 | × | × |

×: NOT PROJECTABLE

CONDITIONS :
LENGTH OF INK FLOW PATH : 7.5 mm
NOZZLE : DIAMETER ON INK JET SIDE : 35 μm
DIAMETER ON INK FLOW PATH SIDE : 72 μm
LENGTH : 100 μm
INK : VISCOSITY : 2 mPa·s, SURFACE TENSION : 30 mN/m
DRIVING VOLTAGE AMPLITUDE : 20 V
DRIVING FREQUENCY : 10 kHz
DEFINITION : 720 dpi

INK-JET DEVICE HAVING PHASE SHIFTED DRIVING SIGNALS AND A DRIVING METHOD THEREOF

BACKGROUND OF THE INVENTION

1. Field of the Invention

The invention relates to an ink-jet device and a method for driving the ink-jet device.

2. Description of Related Art

Impact printers have been giving way to non-impact printers, which are now remarkably expanding the market. Of the non-impact printers, an ink-jet printer is the most noticeable because of its simple principle and facility of displaying data in multiple gradation and in full color. Of the ink-jet printers, the drop-on-demand type which projects only droplets of ink to be used for printing characters is rapidly achieving widespread use due to good ink projection efficiency and low running cost.

As representative drop-on-demand type ink jet printers, there have been disclosed a Kyser type in U.S. Pat. No. 3,946,398 and a thermal-jet type in Japanese unexamined Patent Publication No. 55-27282. These types, however, have such very difficult problems that the former is hard to miniaturize, while the latter is required to use heat-resistant ink because heat is applied to the ink.

For simultaneous solutions to the above-described problems, newly proposed is a device utilizing a modification of piezoelectric ceramic shear mode that has been disclosed in U.S. Pat. No. 4,879,568.

As shown in FIGS. 1 and 2, the ink-jet device 600 using the piezoelectric ceramic shear mode and a method for driving the ink-jet device comprises a bottom wall 601, a top wall 602, and shear mode actuator walls 603 disposed therebetween. The actuator walls 603 each comprise a lower wall 607 attached to the bottom wall 601 and polarized in the direction of an arrow 611, and an upper wall 605 attached to the top wall 602 and polarized in the direction of an arrow 609. The actuator wall 603 serves in pairs, between which an ink flow passage 613 is formed; and between adjacent pairs of actuator walls 603 is formed a space 615 which is narrower than the ink flow passage 613.

In one end of the ink flow passages 613 a nozzle plate 617 having nozzles 618 is secured, and on both sides of each actuator wall 603 are provided electrodes 619 and 621 as metal layers respectively. Specifically, on the actuator wall 603 on the ink flow passage 613 side the electrode 619 is provided, and on the actuator wall 603 on the space 615 side the electrode 621 is provided. The surface of the electrode 619 is covered with an insulating layer 630 for insulation from the ink. The electrode 621 facing the space 615 is connected to a ground 623, while the electrode 619 provided in the ink flow passage 613 is connected to a driving circuit 625 which gives an actuator driving signal.

Next, the method of manufacturing the ink-jet device 600 will be explained. First, a piezoelectric ceramic layer polarized in the direction of the arrow 611 is attached to the bottom wall 601, and a piezoelectric ceramic layer polarized in the direction of the arrow 609 is glued to the top wall 602. The thickness of each piezoelectric layer is equal to the height of the lower wall 607 and the upper wall 605. Next, parallel notches are formed in the piezoelectric ceramic layer by utilizing the rotation of a diamond cutting disk, thereby forming the lower wall 607 and the upper wall 605. The electrodes 619 and 621 are formed by a vacuum evaporation process on the sides of the lower wall 607 respectively. On the electrode 619 is provided the insulating layer 630. In a similar manner the electrodes 619 and 621 are formed on the sides of the upper wall 605 respectively, and on the electrode 619 the insulating layer 630 is provided.

The peaks between the notches of the upper wall 605 and the zenithal section of the lower wall 607 are bonded together to define the ink flow passages 613 and the spaces 615. Next, the nozzle plate 617 forming the nozzles 618 is bonded to one end of the ink flow passage 613 and the space 615 so that the nozzle 618 will correspond to the ink flow passage 613, and the other end of the ink flow passage 613 and the space 615 are electrically connected to the driving circuit 625 and to the earth ground 623.

Then the electrode 619 of each ink flow passage 613 is applied with a voltage from the driving circuit 625, whereby each actuator wall 603 undergoes a piezoelectric thickness deformation in a direction such that the volume of the ink flow passage 613 will increase.

FIG. 3 shows one example of the piezoelectric thickness deformation. When a specific voltage E (V) is applied to an electrode 619C of an ink flow passage 613C, there is produced an electric field in actuator walls 603E and 603F in the direction of arrows 629 and 630 respectively, causing the actuator walls 603E and 603F to undergo the piezoelectric thickness deformation in the direction in which the volume of the ink flow passage 613C will increase. At this time the pressure in the ink flow passage 613C including the vicinity of the nozzle 618C will decrease. This condition is maintained for a period of time T for one-way propagation of the pressure wave in the longitudinal direction within the ink flow passage 613. Then, the ink is supplied during this period of time from a common ink chamber 626 into the ink flow passage 613.

The time T for one-way propagation stated above is the time required by the pressure wave in the ink flow passage 613 to propagate longitudinally in the ink flow passage 613; T=L/a is determined by the length L of the ink flow passage 613 and the speed of sound "a" in the ink flowing in the ink flow passage 613. According to the pressure wave propagation theory, when the time T after the application of the voltage has passed, the pressure in the ink flow passage 613 turns to a positive pressure. The voltage being applied to the electrode 619C of the ink flow passage 613C is reset to zero in accordance with the inversion.

Then, the actuator walls 603E and 603F return to the condition before the deformation shown in FIG. 1, applying a pressure to the ink. Thus when the pressure that has turned into the positive pressure and the pressure established by the recovery of the actuator walls 603E and 603F to the condition before the deformation are combined, a relatively high pressure is established in the vicinity of the nozzle 618C of the ink flow passage 613C, ejecting the ink from the nozzle 618C.

However, if the ink is ejected at one time from a plurality of adjacent ink flow passages 613, a peak current increases, and a voltage drop occurs in the wiring, resulting in a lowered driving voltage and giving an adverse effect to ink ejection. Also, it becomes necessary to use a larger-diameter power source wiring in the driving circuit, which will increase the size and cost of the circuit.

To solve these problems, the ink-jet device was driven with the phases of the driving voltage signals to be applied to the actuator walls 603 corresponding to the plurality of adjacent ink passages 613 mutually shifted. As shown in FIG. 4, a quick-phase first driving signal 510 and a slow-phase second driving signal 520 are shifted by D in phase though the driving voltage amplitude E (V) and the pulse width WC are common.

However, the method for driving the ink-jet device of the above-described constitution has a problem that since the ink-jet device is driven with the phases of the driving voltage signals to be applied to the actuator walls 603 deviated in relation to the plurality of adjacent ink flow passages 613, the target position on paper of ink droplets ejected being deviated by the amount of phase shift, resulting in a deteriorated printing quality.

Deviation of the target position on paper of ink droplets will be explained by referring to a graph shown in FIG. 5.

FIG. 5 shows the amount of deviation of the ink-jet target position when printing of 720 dpi resolution is done by ejecting the ink onto the paper placed 1 mm apart from the nozzle at a frequency of 10 kHz. It is understood that at an ink-jet velocity of 5 m/s, the amount of deviation of the target position varies to 3.5 $\mu$m, 7.1 $\mu$m and 10.6 $\mu$m with the change of the phase difference of 10 $\mu$s, 20 $\mu$s and 30 $\mu$s, respectively.

Furthermore, the deviation of the target position of ink droplets can be corrected by changing the ink-jet velocity to 5.25 m/s, 5.55 m/s and 5.9 m/s in accordance with a slow-phase driving voltage signal when the phase difference varies to 10 $\mu$s, 20 $\mu$s, and 30 $\mu$s; therefore the amplitude of the driving voltage signal is changed by the quick-phase driving voltage signal and the slow-phase driving voltage signal so that the ink droplets to be projected will simultaneously reach a recording medium (e.g., paper) notwithstanding the phase difference of the driving voltage signal, thus resulting in adverse effects of the necessity of two or more power sources and an increased manufacturing cost.

SUMMARY OF THE INVENTION

It is an object of the present invention to provide a low-cost ink-jet device capable of correcting a deviation of an ink-jet target position on paper when the ink-jet device is driven with the phases of driving voltage signals shifted; and acquiring a satisfactory printing quality, and a method for driving the ink-jet device.

To accomplish this object, the invention comprises a plurality of ink flow passages to be filled with ink, ink-jet ports connected to the ink flow passages for ejection of the ink, actuator members for ejecting the ink at the ink-jet ports by decreasing the volume of the ink flow passages after increasing the volume by applying a driving signal, and a control unit for supplying a quick-phase driving signal or a slow-phase driving signal to the actuator members. In this ink-jet device, the quick-phase driving signal and the slow-phase driving signal outputted from the control unit have the same peak value, but differ in the pulse width. Accordingly, the ink-jet velocity for ejecting the droplets of ink according to the slow-phase driving signal can be made greater then the ink-jet velocity for ejecting the droplets of ink according to the quick-phase driving signal, thereby correcting the deviation of an ink-jet target position on a recording medium.

Also, by adjusting the pulse width of the slow-phase driving signal outputted by the control unit to equal the time (=1T) for one-way propagation of a pressure wave in the ink flow passage, the ink-jet velocity of the droplets of ink ejected in accordance with the slow-phase driving signal increases to thereby correct the deviation of the ink-jet target position on the recording medium.

Furthermore, by setting the pulse width of the quick-phase driving signal outputted from the control unit within the range of 0.4T to 0.9T, 1.1T to 1.8T, 2.3T to 3.6T, or 4.3T to 5.5T, the droplets of ink are ejected at a substantially slow ink-jet velocity by the pulse thus adjusted, thereby correcting the deviation of the ink-jet target position on the recording medium from the ink droplets ejected according to the slow-phase driving signal and achieving high-quality printing.

In addition, by setting the pulse width of the quick-phase driving signal outputted from the control unit within the range of 0.5T to 0.8T, 1.2T to 1.6T, or 2.6T to 3.4T, the droplets of ink are ejected highly reliably at an appropriately delayed ink-jet velocity by the pulse thus adjusted, thereby correcting the deviation of the ink-jet target position on the recording medium from the ink droplets ejected and achieving high-quality printing corresponding to printing at a high driving frequency.

Furthermore, by setting the pulse width of the quick-phase driving signal outputted from the control unit within the range of 0.6T to 0.8T, 1.2T to 1.4T, or 2.9T to 3.1T, a sufficient quantity of ink droplets are ejected at a slow ink-jet velocity by the pulse thus adjusted, thereby further correcting the deviation of the ink-jet target position on the recording medium from the ink droplets ejected and achieving high-quality, uniform printing.

Furthermore, the actuator members previously stated are actuator walls having piezoelectric elements and the ink flow passages are formed of the actuator walls, so that the volume of an ink chamber varies in accordance with the driving signal applied from the control unit, thus ejecting the ink.

According to the invention, as described above, the quick-phase driving signal and the slow-phase driving signal outputted by the control unit have the same peak value, but differ in the pulse width, thereby causing the ink-jet velocity at which droplets of ink are ejected in accordance with the slow-phase driving signal to increase compared to the ink-jet velocity at which droplets of ink are projected in accordance with the quick-phase driving signal, thus enabling high-quality recording without deviation of the ink-jet target position on the recording medium. Also, because the device can be driven by a single driving power source, it is possible to decrease the cost more than the related art device.

Furthermore, because the pulse width of the slow-phase driving signal outputted from the control unit is the same as the time for one-way propagation of the pressure wave in the ink flow passage, it is, therefore, possible to increase the ink-jet velocity and the efficiency of ejecting the droplets of ink.

BRIEF DESCRIPTION OF THE DRAWINGS

A preferred embodiment of the invention will be described in detail with reference to the following figures wherein:

FIG. 8 is a view showing a result of changes in an ink-jet velocity and in the quantity of droplets of ink when a pulse width WA of the first driving waveform is altered.

DETAILED DESCRIPTION OF PREFERRED EMBODIMENT

Figure 1:
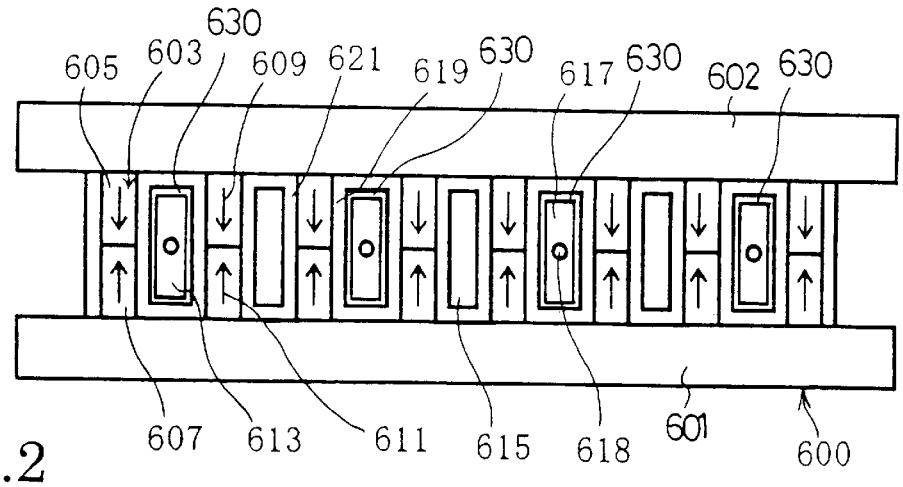
Fig.1 PRIOR ART
FIG. 1 is a front view showing the constitution of the invention and a related art ink-jet device.
Figure 2:
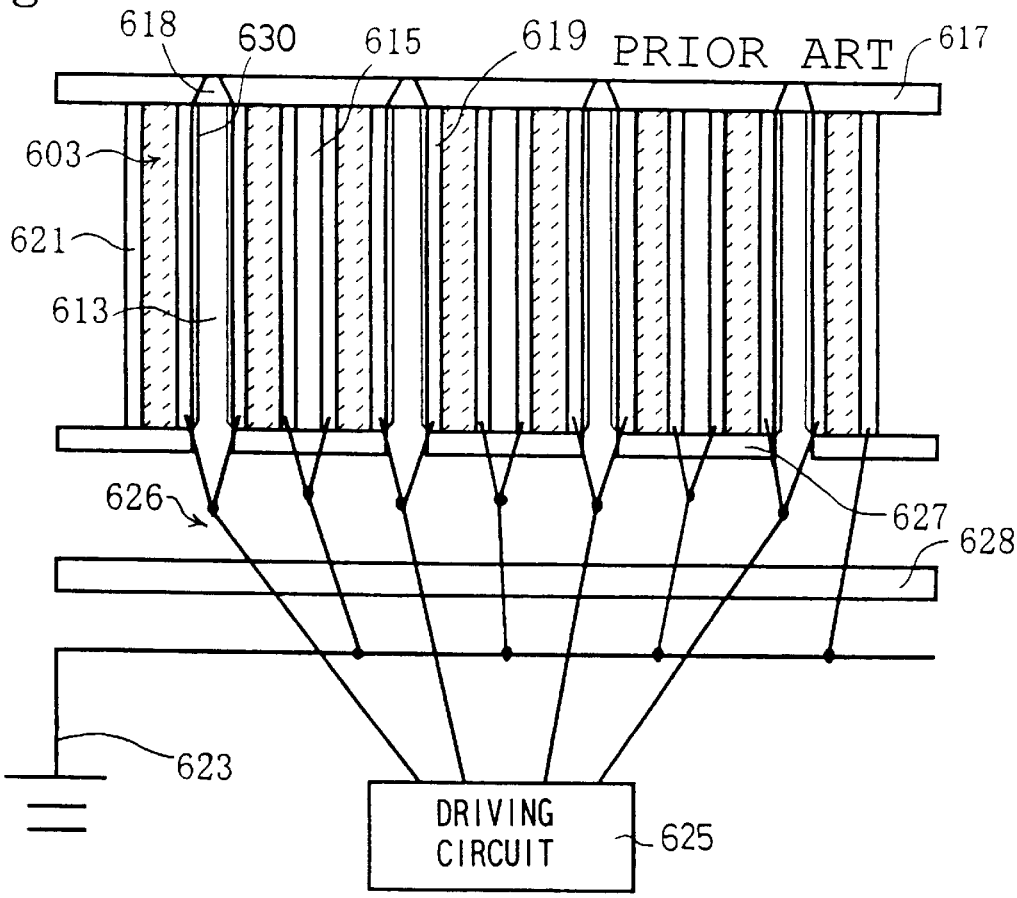
Fig.2 PRIOR ART
FIG. 2 is a plan view showing the constitution of the related art ink-jet device.
Figure 3:
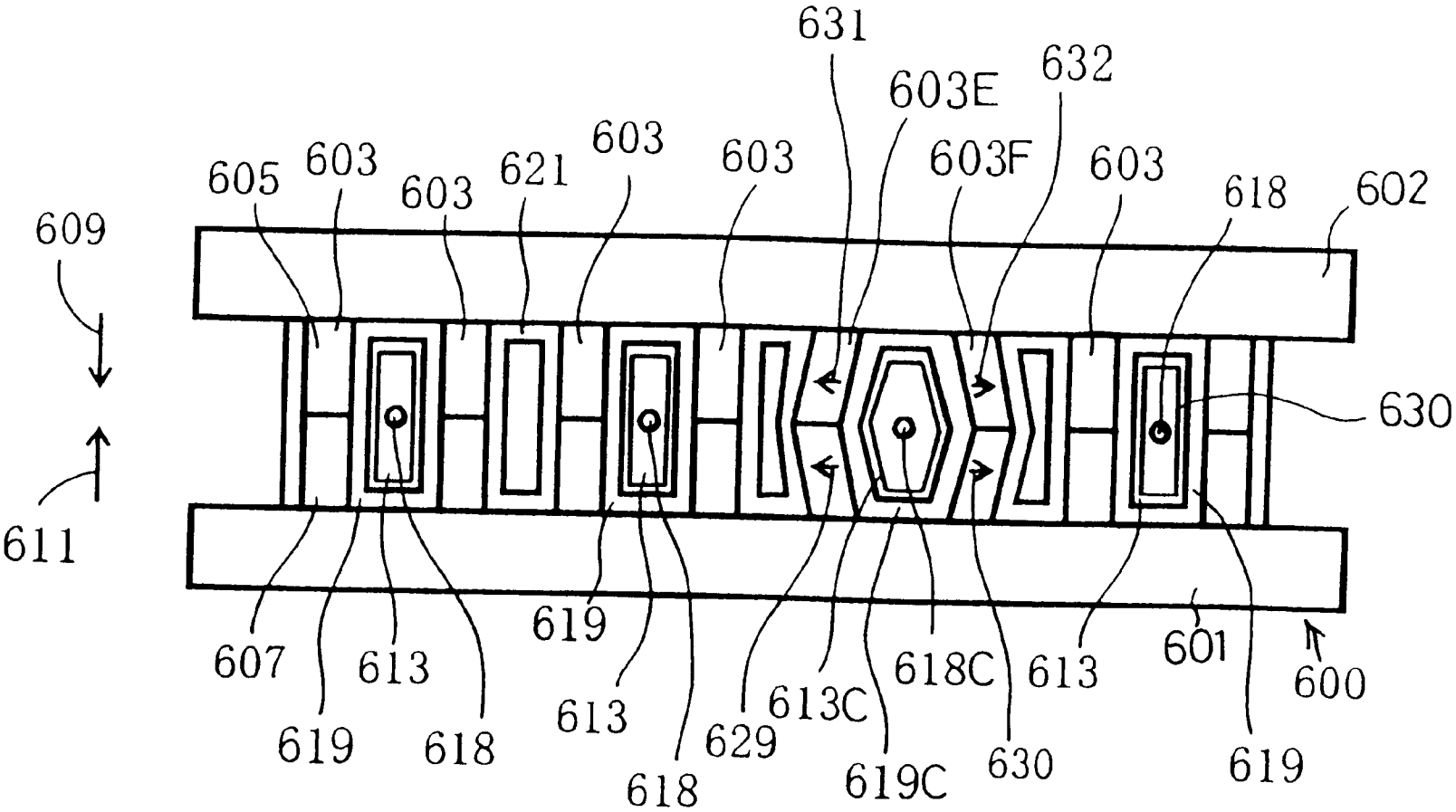
Fig.3 PRIOR ART
FIG. 3 is a front view showing the mode of operation of the related art ink-jet device.
Figure 4:
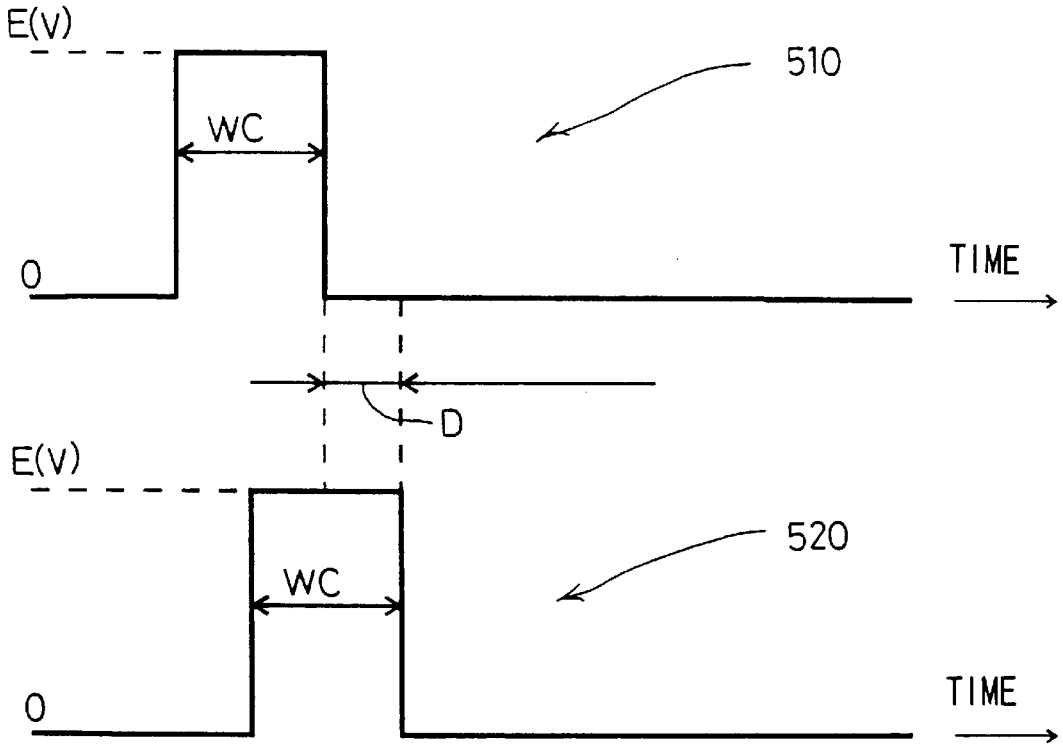
Fig.4 PRIOR ART
FIG. 4 is a view showing a driving voltage signal pertaining to the related art.

Hereinafter one embodiment of an ink-jet device according to the present invention will be explained with reference to the accompanying drawings. It should be noted that the same elements as those of the related art are designated by the same reference numerals, and therefore will not be further explained.

The ink-jet device 600 of an embodiment of the invention comprises the bottom wall 601, the top wall 602, and the shear mode actuator walls 603 disposed therebetween as in the case of the related art ink-jet device 600. The actuator walls 603 comprise the lower wall 607 bonded to the bottom wall 601 and polarized in the direction of the arrow 611, and the upper wall 605 bonded to the top wall 602 and polarized in the direction of the arrow 609. The actuator wall 603 serves in pairs, between which the ink flow passages 613 are formed and between the adjacent pairs of actuator walls 603 the space 615 which is narrower than the ink flow passage 613 is formed.

In one end of the ink flow passages 613 are fitted the nozzle plate 617 in which the ink-jet nozzles 618 are formed. On both side faces of each actuator wall 603 are provided electrodes 619 and 621 as metal layers, respectively. Each of the electrodes 619 and 621 is covered with an insulating layer 630 for insulation from the ink. Then, the electrode 621 exposed to the space 615 is connected to the ground 623; and the electrode 619 provided in the ink flow passage 613 is connected to the driving circuit 625 which drives the actuator.

One example of concrete dimensions of the ink-jet device may be the length L of 7.5 mm of the ink flow passage 613. The nozzle 618 includes the diameter of 35 μm on the ink-jet side, the diameter of 72 μm on the ink flow passage 613 side, and the length of 100 μm. Also, the ink used in the experiments had the viscosity of 2 mPa·s and the surface tension of 30 mN/m. The ratio of the speed of sound "a" in the ink flowing in the ink flow passage 613 to the length L of the ink flow passage 613, L/a (=T), was 12 μsec.

Then, with the application of the voltage from the driving circuit 625 to the electrode 619 of each ink flow passage 613, each actuator wall 603 is subjected to piezoelectric thickness deformation in a direction in which the volume of the ink flow passage 613 increases.

Here, the driving circuit 625 is connected with a single power source 118 for producing the driving voltage of, for example, 20 (V) and a CPU 110 which controls the driving circuit 625. To the CPU 110 are connected a ROM 112 used for the storage of sequence data and control programs of the first driving waveform 10 having a pulse WA described later and the second driving waveform 20 having a pulse WB, a RAM 114 for the storage of print data and working data, and a print data receiving circuit 116 for receiving print data and image data from an external device (not shown). The CPU 110 functions to read the sequence data of the driving waveform stored in the ROM 112 to control the driving circuit 625, thereby generating the first driving waveform 10 and the second driving waveform 20 of the present embodiment.

Figure 7:
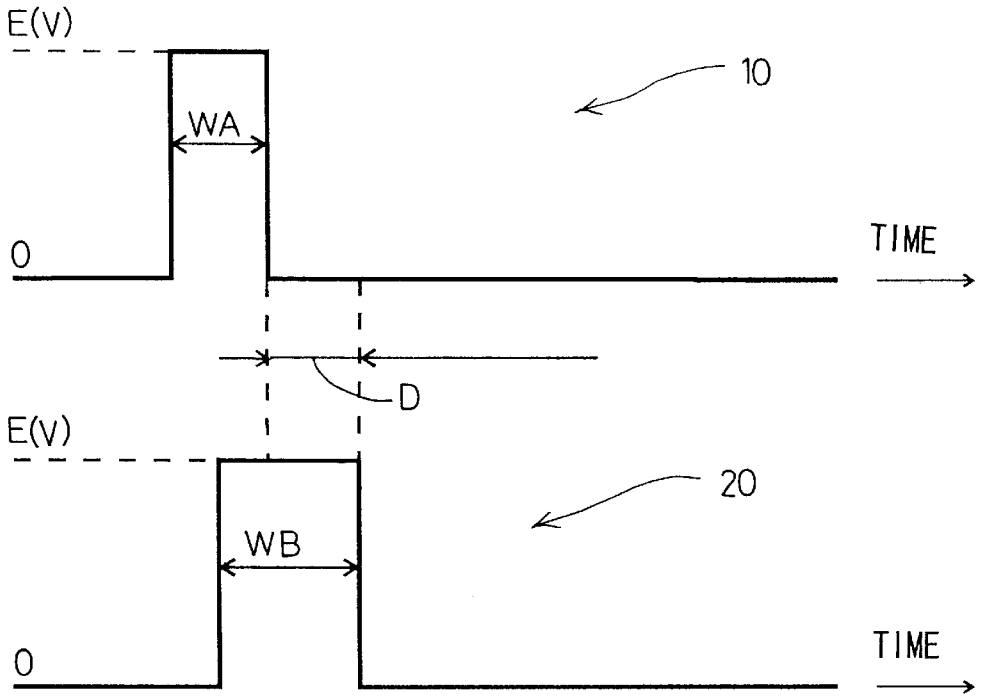
FIG. 7 is a view showing first and second driving waveforms of one embodiment of the ink-jet device according to the invention.

Next, the driving waveforms 10 and 20 to be applied to the electrode 619 in the ink flow passage 613 are shown in FIG. 7. The first driving waveform 10 is a quick-phase driving voltage waveform, while the second driving waveform 20 is a slow-phase driving voltage waveform. The first driving waveform 10 and the second driving waveform 20 have the same amplitude E (V) of the driving voltage signal, but differ in the pulse widths WA and WB. A phase difference is D.

The pulse width WB of the second driving waveform 20 agrees with the one-way propagation time T of the ink pressure wave in the ink flow passage 613 stated above, that is, 12 μsec; therefore a comparatively high pressure is built in a part near the nozzle 618 in the ink flow passage 613, thereby ejecting the ink from the nozzle 618 at a comparatively high jet velocity. On the other hand, the pulse width WA of the first driving waveform 10 is shorter, for example about 8 μsec, than the one-way propagation time T of the ink pressure wave in the ink flow passage 613; since the ink pressure near the nozzle 618 in the ink flow passage 613 does not sufficiently increase, the ink is projected from the nozzle 618 at a lower jet velocity than the ink projection of the second driving waveform 20.

In this case, the pulse width WA of the first driving waveform 10 is desired to differ from the one-way propagation time T of the ink pressure waveform; if the pulse width WA is increased to for example about 16 μsec more than the one-way propagation time T of the ink pressure wave in the ink flow passage 613, the ink will be ejected from the nozzle 618 at a relatively low ink-jet velocity as compared with the ink projection of the second driving waveform 20 because of insufficient rise of the ink pressure in the vicinity of the nozzle 618 of the ink flow passage 613.

Next, a result of ink-jet tests conducted by using the ink-jet device 600 of the present embodiment will be explained.

In the ink-jet tests, printing was performed on paper placed 1 mm apart, at a frequency of 10 kHz and at resolution of 720 dpi; the amplitude E (V) of the driving voltage signal of the slow-phase second driving waveform 20 and the quick-phase first driving waveform 10 shown in FIG. 7 was 20 V; and the phase difference D of the first driving waveform 10 and the second driving waveform 20 was 20 μsec.

Figure 5:
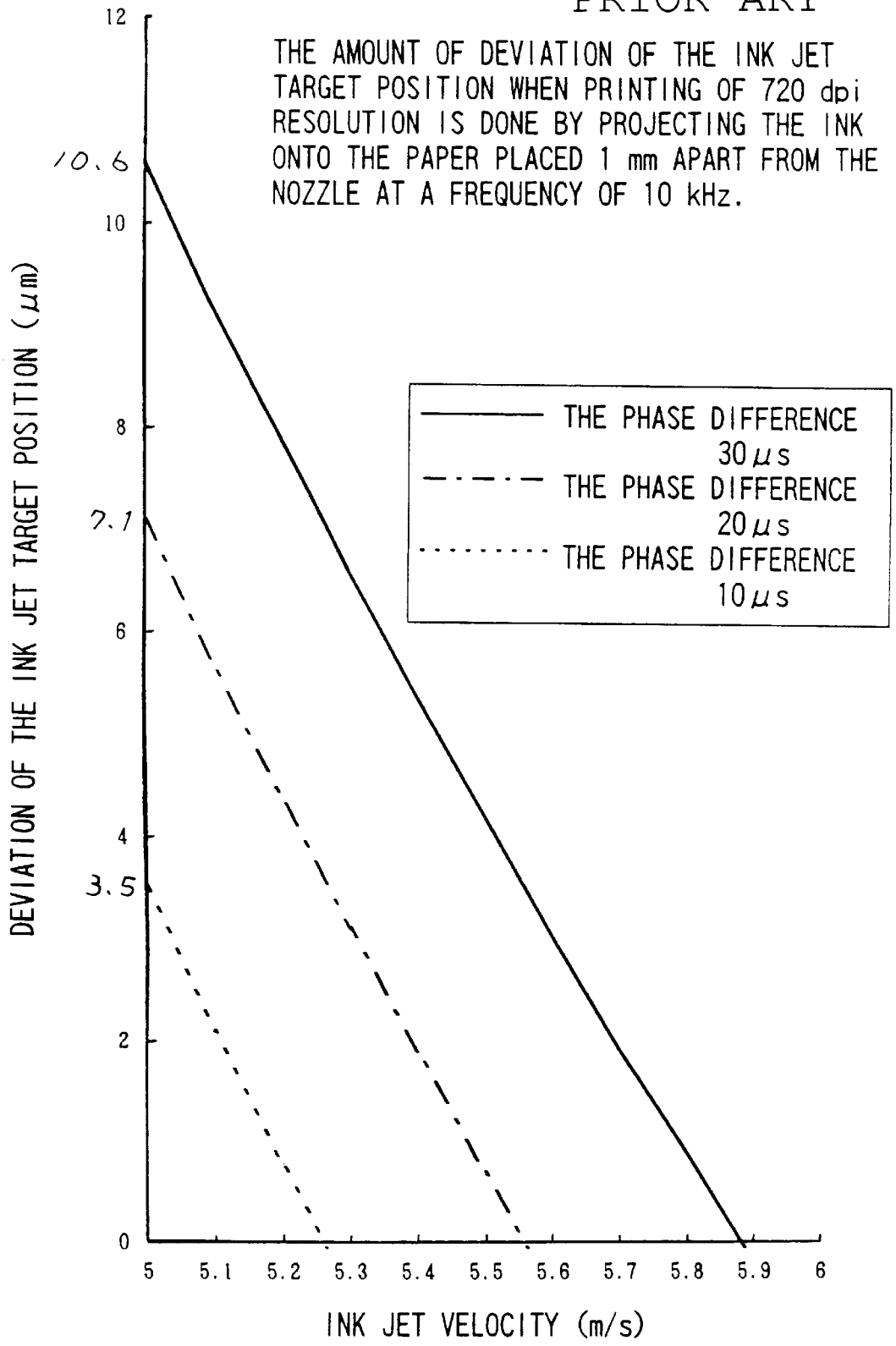
Fig.5 PRIOR ART
FIG. 5 is a view showing a phase difference and the amount of deviation of the related art and the invention.
Figure 6:
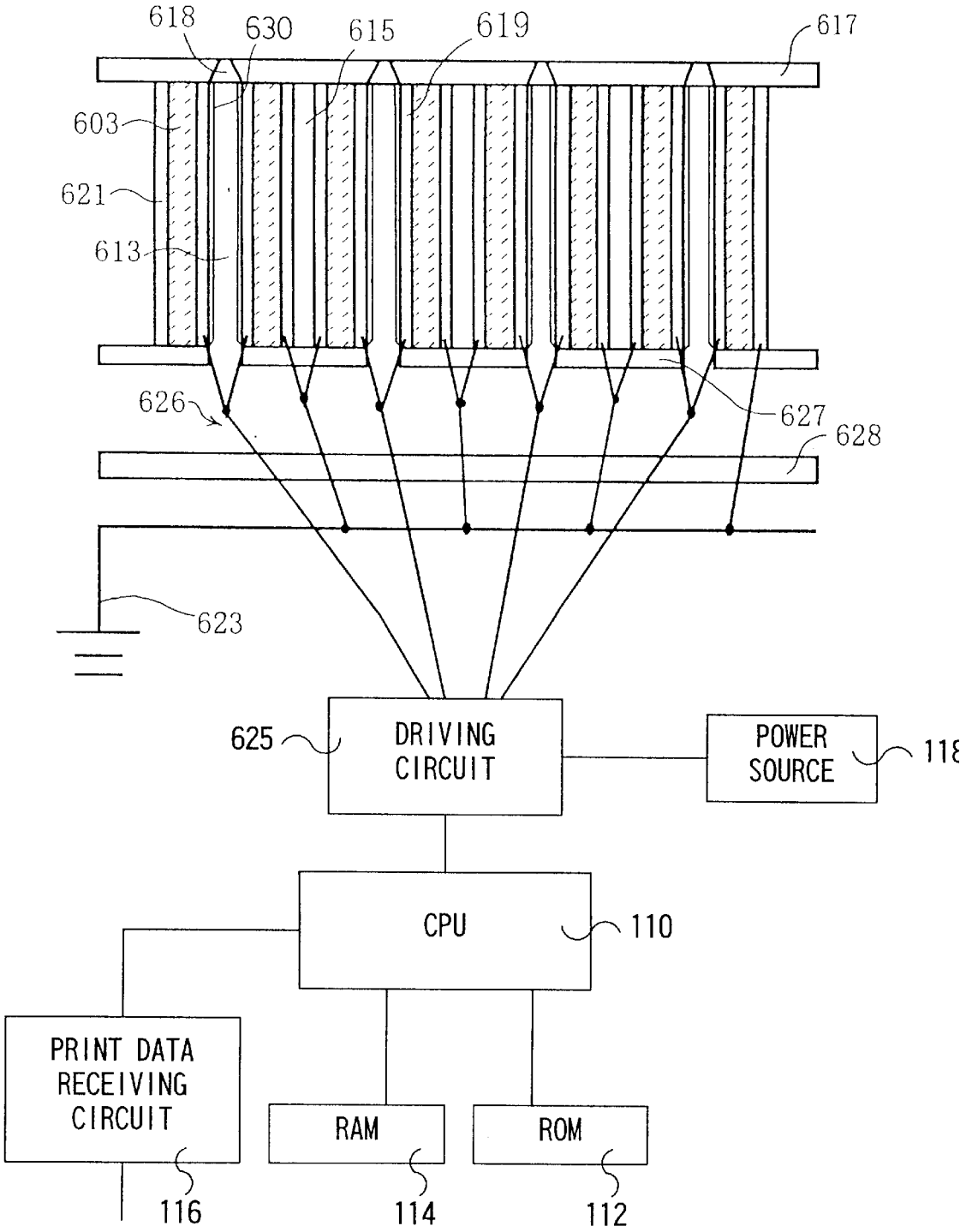
FIG. 6 is a plan view showing the constitution of one embodiment of the ink-jet device according to the invention.

With the first driving waveform 10, the ink-jet velocity was 5.0 m/s; and with the second driving waveform 20, the ink-jet velocity was 5.6 m/s. It is understood that, as shown in FIG. 5, when the phase difference is 20 μs, the deviation of the ink-jet target position can be eliminated almost completely by setting the jet velocity of the ink ejected according to the quick-phase driving voltage signal to 5 m/s and the jet velocity of the ink ejected according to the slow-phase driving voltage signal to 5.6 m/s, thereby enabling high-quality printing.

The voltage E (V) applied to the electrode 619 from the driving circuit 625 is constant at E(V)=20 (V), and therefore just connecting the single driving power source 118 to the driving circuit 625 suffices. The cost of the device of the invention, therefore, can be reduced more than the related art device.

Next, a result of ink-jet tests carried out with the pulse width WA of the first driving waveform 10 changed will be explained.

A result of changes in the ink-jet velocity and the quantity of the droplets of ink discharged at this time is shown in FIG. 8.

As shown in FIG. 8, the ejection of the ink droplets is done at a relatively slow jet velocity at the pulse width WA of the first driving waveform 10 which is set in the range of 0.4T to 0.9T, 1.1T to 1.8T, 2.3T to 3.6T, or 4.3T to 5.5T, thereby enabling the correction of the deviation of the ink-jet target position from the droplets of ink ejected with the second driving waveform 20 on the recording medium.

However, the ink-jet velocity, if extremely slow, becomes liable to the influence of disturbance, resulting in variation in the accuracy of the projection target of ink droplets and accordingly in deteriorated printing quality. Furthermore, if the jet velocity is slow, it will become impossible to correct the ink-jet target position on the recording medium from the ink droplets projected with the second driving waveform 20 unless the phase difference D of the first driving waveform 10 and the second driving waveform 20 is largely increased, with the result that a time for the driving cycle of printing one line is prolonged and accordingly a high driving frequency can not be achieved. That is, the printing velocity will be limited. Similarly, provided the pulse width WA of the first driving waveform 10 is too long, the driving cycle will become longer, making it impossible to increase the printing velocity. With the above-described taken into account, it is desirable to set the pulse width WA of the first driving waveform 10 within the range of 0.5T to 0.8T, 1.2T to 1.6T or 2.6T to 3.4T.

In addition, as to the amount of the ink droplets, to restrain variation in the dot diameter on the recording medium of the droplets of ink being ejected with the first driving waveform 10 and with the second driving waveform 20, it is desirable that the pulse width WA of the first driving waveform 10 be set within the range of 0.6T to 0.8T, 1.2T to 1.4T, or 2.9T to 3.1T, whereby the deviation of the ink-jet target on the recording medium can be corrected more accurately, thus achieving high-quality printing without unevenness of printing.

One embodiment of the ink-jet device according to the invention has been explained in detail, but it should be noted that the invention is not limited thereto. For example, in the present embodiment the nozzle and the driving phase are divided into two types, but may be three types or more. Also, various modifications and improvements of the amount of phase deviation, the pulse width, and other types of constitutions may be effected by one of ordinary skill in the art.

Also, in the present embodiment the ink is ejected by utilizing a modification of a piezoelectric element and may be projected with the volume of the ink flow passage changed by means of a solenoid or other appropriate means.

What is claimed is:

1. An ink-jet device comprising:

a plurality of ink flow passages filled with ink;

nozzles connected to said ink flow passages from which said ink is ejected;

actuator members including at least a first actuator member and a second actuator member, the actuator members ejecting said ink from said nozzles by decreasing a volume of said ink flow passages after increasing the volume of said ink flow passages in accordance with a driving signal supplied; and a control unit supplying a first driving signal to said first actuator member and a second driving signal to said second actuator member, said first driving signal being phase shifted from said second driving signal, said first driving signal having a first peak value and a first pulse width and said second driving signal having a second peak value and a second pulse width, the first peak value being the same as the second peak value and the first pulse width being different from the second pulse width.

2. An ink-jet device according to claim 1, wherein the second pulse width has a same duration as a one-way propagation time T of a pressure wave generated in said ink flow passages.

3. An ink-jet device according to claim 2, wherein the first pulse width is within 0.4T to 0.9T, 1.1T to 1.8T, 2.3T to 3.6T, or 4.3T to 5.5T.

4. An ink-jet device according to claim 2, wherein the first pulse width is within 0.5T to 0.8T, 1.2T to 1.6T, or 2.6T to 3.4T.

5. An ink-jet device according to claim 2, wherein the first pulse width is within 0.6T to 0.8T, 1.2T to 1.4T, or 2.9T to 3.1T.

6. An ink-jet device according to claim 1, wherein said actuator members are actuator walls at least partly formed from a piezoelectric material, and said ink flow passages are composed of the actuator walls.

7. An ink-jet device according to claim 5, wherein said actuator members are actuator walls at least partly formed from a piezoelectric material, and said ink flow passages are composed of the actuator walls.

8. An ink-jet device according to claim 1, wherein said control unit includes a power source circuit which only generates a single voltage.

9. An ink-jet device according to claim 5, wherein said control unit includes a power source circuit which only generates a single voltage.

10. An ink-jet device according to claim 1, wherein said control unit comprises a CPU, a ROM connected to the CPU storing control programs, a RAM connected to the CPU storing print data, a print data receiving circuit receiving print data, and a driving circuit connected between the CPU and the actuator members, the CPU controlling the driving circuit based on the control programs to supply the first driving signal and the second driving signal to the actuator members.

11. A method for driving an ink-jet device which comprises a plurality of ink flow passages filled with ink, nozzles connected to said ink flow passages from which said ink is ejected, actuator members including at least a first actuator member and a second actuator member, the actuator members ejecting said ink from said nozzles by decreasing the volume of said ink flow passages after increasing a volume of said ink flow passages in accordance with a driving signal supplied by a control unit, the method comprising the steps of:

supplying from the control unit a first driving signal to the first actuator member, and supplying from the control unit a second driving signal to the second actuator member, said first driving signal being phase shifted from said second driving signal, said first driving signal having a first peak value and a first pulse width and said second driving signal having a second peak value and a second pulse width, the first peak value being the same as the second peak value and the first pulse width being different from the second pulse width.

12. A method for driving an ink-jet device according to claim 11, wherein the step of supplying the second driving signal comprises supplying the second driving signal with the second pulse width having a same duration as a one-way propagation time T of a pressure wave generated in said ink flow passages.

13. A method for driving an ink-jet device according to claim 12, wherein the step of supplying the first driving signal comprises supplying the first driving signal with the first pulse width being within 0.4T to 0.9T, 1.1T to 1.8T, 2.3T to 3.6T, or 4.3T to 5.5T.

14. A method for driving an ink-jet device according to claim 12, wherein the step of supplying the first drive signal comprises supplying the first drive signal with the first pulse width being within 0.5T to 0.8T, 1.2T to 1.6T, or 2.6T to 3.4T.

15. A method for driving an ink-jet device according to claim 12, wherein the step of supplying the first driving signal comprises supplying the first driving signal with the first pulse width being within 0.6T to 0.8T, 1.2T to 1.4T, or 2.9T to 3.1T.

16. A method for driving an ink-jet device according to claim 11, wherein said actuator members are actuator walls formed at least partly from a piezoelectric material, and said ink flow passages are composed of the actuator walls.

17. A method for driving an ink-jet device according to claim 15, wherein said actuator members are actuator walls formed at least partly from a piezoelectric material, and said ink flow passages are composed of the actuator walls.

18. A method for driving an ink-jet device according to claim 11, further comprising the step of generating only a single voltage with a power source circuit forming a part of said control unit.

19. A method for driving an ink-jet device according to claim 15, further comprising the step of supplying said control unit with a single voltage from a power source circuit which generates only the single voltage.

* * * * *